United States Patent [19]

Tone et al.

[11] Patent Number: 5,073,984

[45] Date of Patent: Dec. 24, 1991

[54] SIMPLE PROTECTIVE CLOTHING FOR SHIELDING FROM ELECTROMAGNETIC WAVE

[75] Inventors: Masashi Tone; Hideki Fukuyama; Hiroki Hachima, all of Tokyo, Japan

[73] Assignee: Nisshinbo Industries, Inc., Tokyo, Japan

[21] Appl. No.: 587,350

[22] Filed: Oct. 23, 1990

[30] Foreign Application Priority Data

Feb. 28, 1990 [JP] Japan ..... 2-18710[U]

[51] Int. Cl.[5] ..... A41D 13/00

[52] U.S. Cl. ..... 2/2; 2/79; 2/115; 2/102; 2/108; 2/DIG. 7

[58] Field of Search ..... 2/2, DIG. 7, 79, 115, 2/102, 108, 11.5

[56] References Cited

U.S. PATENT DOCUMENTS

| | | | |
|---|---|---|---|
| 3,164,840 | 1/1965 | Reynolds | 2/2 |
| 3,310,053 | 3/1967 | Greenwood | 128/577 |
| 3,422,460 | 1/1969 | Burke et al. | 2/73 |
| 3,877,965 | 4/1975 | Broadbent et al. | 427/304 |
| 4,338,686 | 7/1982 | Bell | 2/2 |
| 4,546,497 | 10/1985 | Ono et al. | 2/243 |
| 4,924,103 | 8/1990 | Stein et al. | 2/2 |

FOREIGN PATENT DOCUMENTS

| | | | |
|---|---|---|---|
| 1902647 | 3/1970 | Fed. Rep. of Germany | 2/115 |

*Primary Examiner*—Werner H. Schroeder
*Assistant Examiner*—Gloria Hale
*Attorney, Agent, or Firm*—Rogers & Killeen

[57] ABSTRACT

Personal protective clothing of the present invention is formed into a vest, a skirt, a cap, a coat or the like by using a surface-metallized fiber woven or knitted fabric. A conductive discharging yarn or fabric is electrically connected to the clothing, and a face cover or both a face cover and a backing are attached thereto. The operators of personal computers, word processors and the like can easily wear the clothing for the purpose of protecting their bodies from the electromagnetic waves generated.

15 Claims, 5 Drawing Sheets

SIMPLE PROTECTIVE CLOTHING FOR SHIELDING FROM ELECTROMAGNETIC WAVE

BACKGROUND OF THE INVENTION

The present invention relates to simple protective clothing for shielding from electromagnetic waves in the form of a vest, a skirt, a protective cap, a coat or the like for protecting a human body from electromagnetic waves, which are generated in all the directions from personal computers, word processors and the like.

Aprons having the function to shield from electromagnetic waves are generally used for protecting the bodies of the operators from electromagnetic waves which are generated from office automation equipment such as personal computers, word processors and the like.

However, such aprons are made of a heavy-gage single fabric which is plated, coated or impregnated with a metal such as nickel, copper or the like, or which is further coated with rubber. The aprons not only are heavy but also give a feeling of bodily discomfort to the operators and thus cause a deterioration in workability. The operators therefore hardly wear the aprons. The aprons also have problems in that they cannot sufficiently protect the backs of the operators and that the operators cannot wear the aprons as street clothes, commuting clothes or the like. Further, since the aprons are made of flat fabrics, the ability to discharge static electricity is unsatisfactory.

SUMMARY OF THE INVENTION

It is an object of the present invention to provide personal protective clothing which is lightweight and comfortable to wear and which has excellent abilities to shield from electromagnetic waves and to destaticize.

In order to achieve the object, a personal protective clothing body of the present invention is formed into a vest, a skirt, a cap, a coat or the like by using a surface-metallized fiber woven or knitted fabric. A conductive discharging yarn or fabric is electrically connected to the protection clothing body so that the effect of shielding from electromagnetic waves can be made remarkable. In addition, a face cover or both a face cover and a backing are attached to the body so that the wearing comfortableness can be improved.

A woven or knitted fabric having surfaces metallized by plating or the like is used as the surface-metallized fiber woven or knitted fabric in the present invention. It is preferable that the woven or knitted fabric is as lightweight as possible and has an appropriate level of permeability. Examples of fibers that satisfy the conditions include natural fibers such as cotton and hemp fibers and the like, and synthetic fibers such as polyester, nylon and acrylic fibers and the like. Synthetic fibers are preferable from the viewpoint of plating properties. The yarn used is preferably a monofilament having a size of 20d to 150d, a multifilament having a size of 50d to 300d, or a yarn of a yarn number count of 10s to 300s. The weight of the woven or knitted fabric used is preferably 20 g to 200 g/m$^2$.

Although the texture of a woven fabric is preferably leno or plain gauze, Habutae, calico or the like is also suitable. The texture of a knitted fabric is preferably tulle net or raschel lace.

Although the surfaces of the woven or knitted fabric can be metallized by an electrolytic plating method, an electroless plating method, a sputtering method, a spray method or the like, a electroless plating method is preferable. This electroless plating is chemical plating effected in a wet system using a reducing agent. Copper or nickel is preferable as a plating metal. The thickness of the metallic deposit is preferably 0.1 to 3 $\mu$, and the amount of the metal adhering the fabric used is preferably 5 to 40% of the total weight. The electroless plating method is suitable for coating a copper or nickel film on a woven or knitted fabric.

In the present invention, although the body of personal protective clothing is manufactured by using the surface-metallized fiber woven or knitted fabric formed by the above method, the body is preferably formed so that the operators can easily wear and remove it.

Further, in the present invention, since the electromagnetic waves absorbed by the body of the personal protective clothing and the static electricity produced in the body are converted into heat and released as ohmic loss, the use of a conductive dischargeable yarn or fabric is further effective.

In this case, the static electricity produced in the body of the personal protective clothing can be rapidly discharged by electrically connecting such a conductive dischargeable yarn or fabric to the clothing body.

In addition, such a conductive dischargeable yarn or fabric is suspended from an appropriate portion of the yarn or fabric so that it can be used as earth. In this case, the earthing effect also causes an increase in the efficiency of catching and reflection of the electric field component of the electromagnetic waves generated.

Examples of conductive dischargeable yarns or fabrics, that may be effectively used in the present invention, include strings of spun yarns (for example, Sanderlon lily yarns manufactured by Nippon Sanmo Senshoku K. K.) which are made of acrylic short fibers which are made conductive by forming metal complexes therein using copper sulfide or the like, felt-like mats formed by needle punching acrylic short fibers which are plated with copper or nickel and the like.

DETAILED DESCRIPTION OF PREFERRED EMBODIMENTS

Embodiments of the present invention are described below with reference to the drawings.

Figure 1:
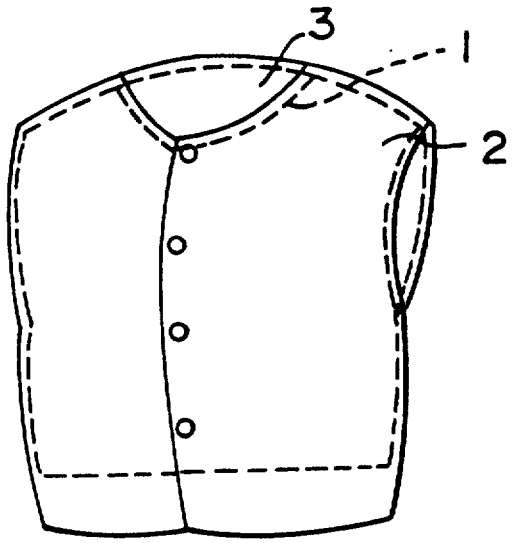
FIG. 1 is a perspective view of an embodiment of the present invention in the form of a vest.
Figure 2:
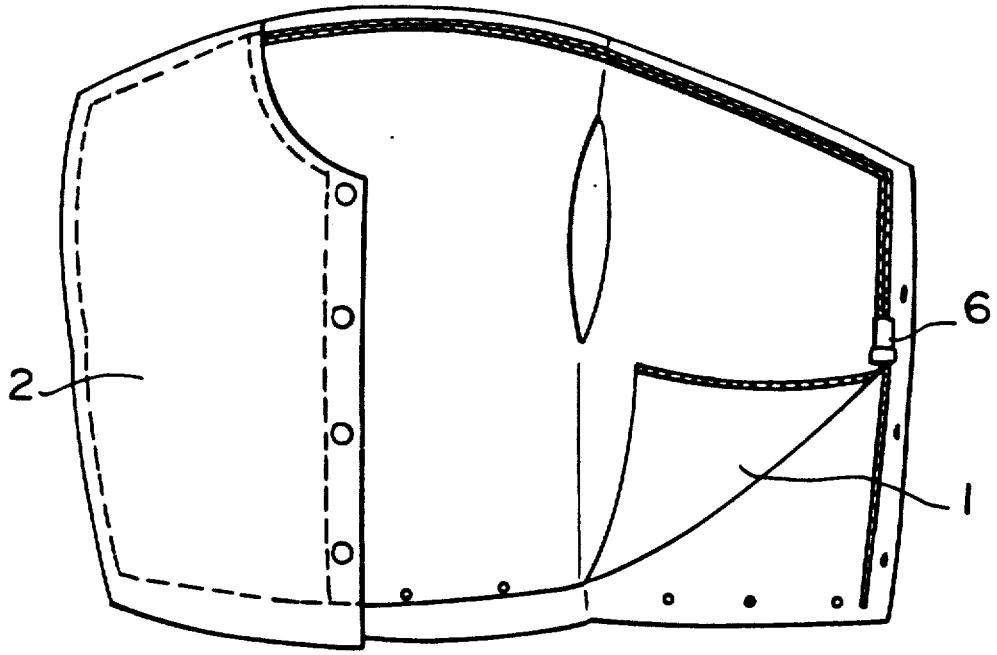
FIG. 2 is a perspective view of an embodiment in which a face cover is attached to the vest-formed personal protective clothing shown in FIG. 1 by means of a fastener.
Figure 3A:
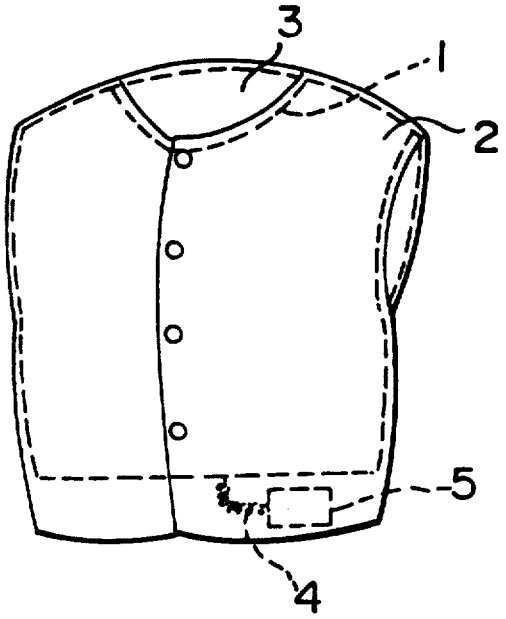
FIG. 3*a* is a perspective view of another embodiment in the form of a vest.
Figure 3B:
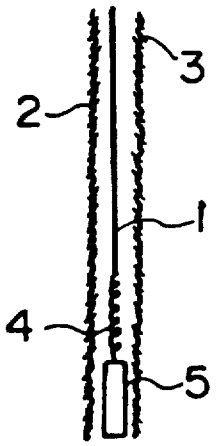
FIG. 3*b* and 3*c* are sectional drawings which respectively show examples of the embodiment shown in FIG. 3*a*.
Figure 3C:
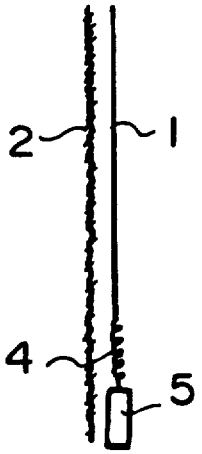
Figure 4A:
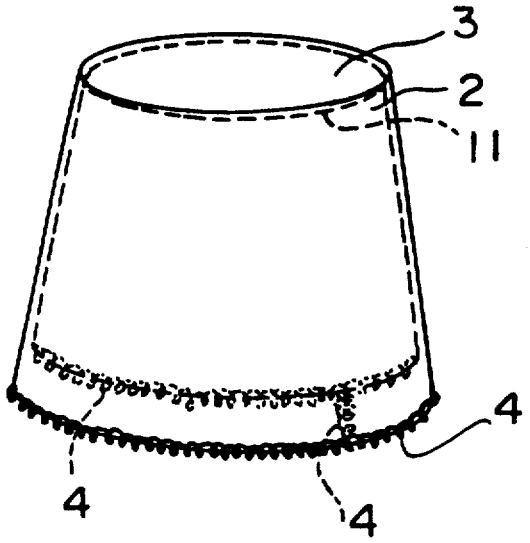
FIG. 4*a* is a perspective view of an embodiment in the form of a skirt.
Figure 4B:
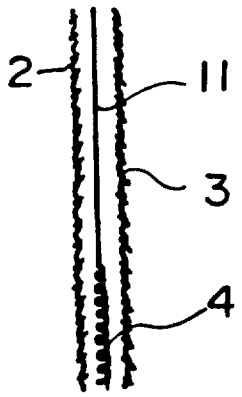
FIGS. 4*b* and 4*c* are sectional drawings which respectively show examples of the embodiment shown in FIG. 4*a*.
Figure 4C:
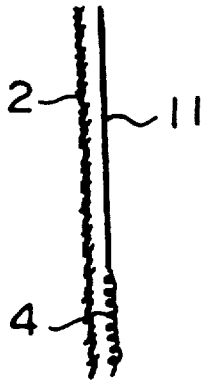
Figure 5A:
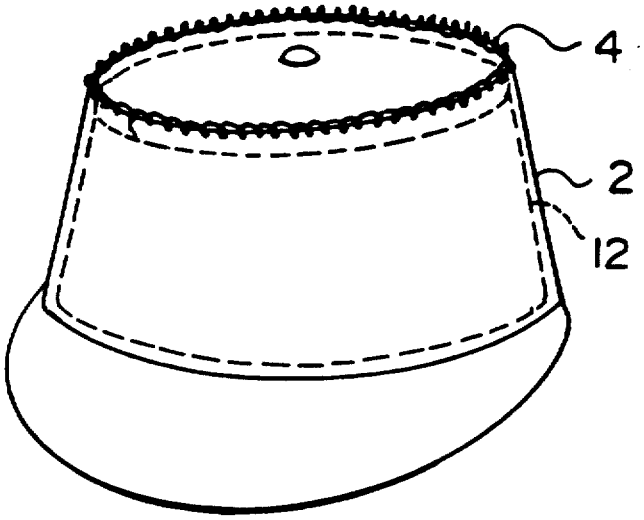
FIG. 5*a* is a perspective view of an embodiment in the form of a cap.
Figure 5B:
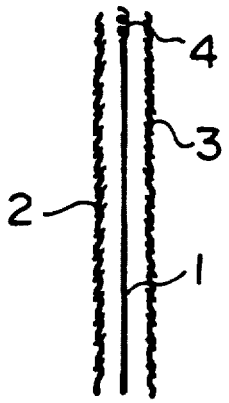
FIG. 5*b* is a sectional drawing which shows an example of the embodiment shown in FIG. 5*a*.
Figure 6:
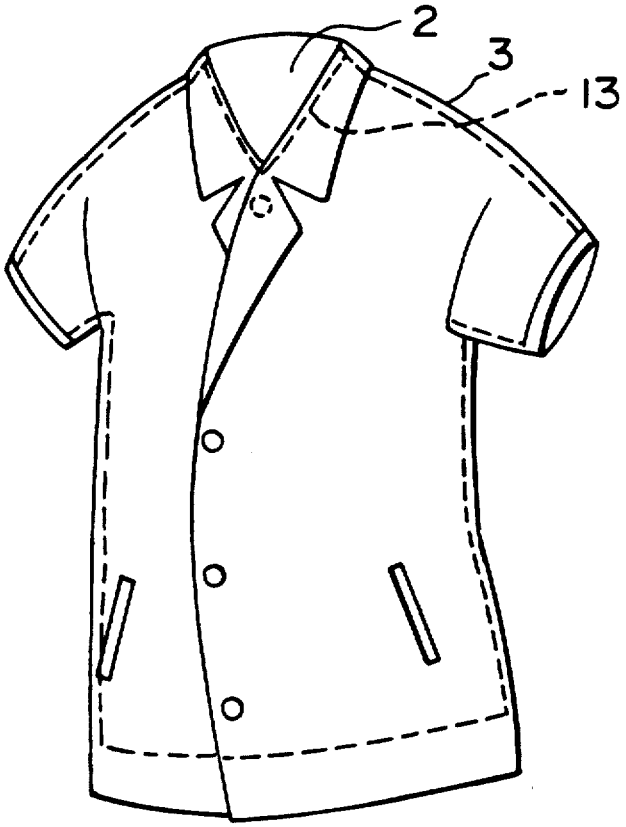
FIG. 6 is a perspective view of an embodiment in the form of a coat.
Figure 7A:
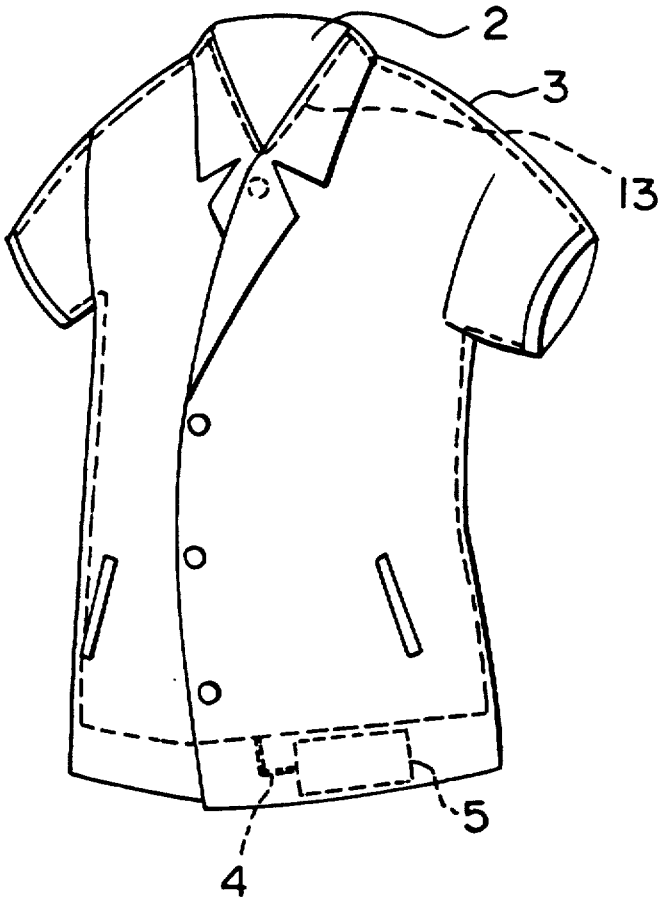
FIG. 7*a* is a perspective view of another embodiment in the form of a coat.
Figure 7B:
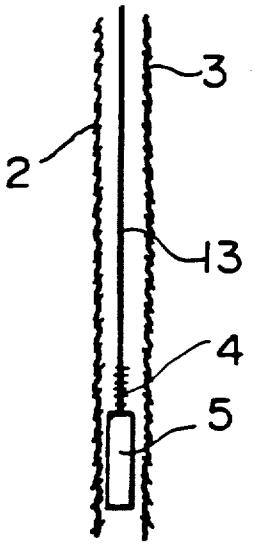
FIG. 7*b* is a sectional drawing which shows an example of the embodiment shown in FIG. 7*a*.

FIG. 1 is a perspective view of an embodiment of the present invention in the form of a vest, FIG. 2 is a perspective view of an embodiment in which a face cover is detachably provided on the vest-formed personal protective clothing shown in FIG. 1 by means of a fastener, FIG. 3*a* is a perspective view of another embodiment in the form of a vest, FIG. 3*b* and 3*c* are sectional drawings which respectively show examples of the embodiment shown in FIG. 3*a*, FIG. 4*a* is a perspective view of an embodiment in the form of a skirt, FIGS. 4*b* and 4*c* are sectional drawings which respectively show examples of the embodiment shown in FIG. 4*a*, FIG. 5*a* is a perspective view of an embodiment in the form of a cap, FIG. 5*b* is a sectional drawing which shows an example of the embodiment shown in FIG. 5*a*, FIG. 6 is a perspective view of an embodiment in the form of a coat, FIG. 7*a* is a perspective view of another embodiment in the form of a coat, and FIG. 7*b* is a sectional drawing which shows an example of the embodiment shown in FIG. 7*a*.

In FIG. 1, reference numeral 1 denotes a vest-formed personal protective clothing body which is formed by using a surface-metallized fabric. A face cover 2 and/or a backing 3 may be attached to the Protective clothing body for the purpose of improving wearing properties and wearing comfortableness. The face cover 2 and/or the backing 3 may be detachably provided on the protective clothing body by means of fastener, a face fastener, hook or the like. In this case, it is convenient that the face cover 2 and the backing 3 are separated from the body and then washed. In FIG. 2, a face cover 2 is detachably provided on the protective clothing body 1 by means of a fastener. The backing 3 is not attached to the body in this case.

FIG. 3*a* shows an embodiment in which a conductive discharging mat 5 is attached to the body of the personal protective clothing body 1 shown in FIG. 1 through a conductive discharging yarn 4. The conductive discharging yarn 4 is further suspended from the mat 5 so that the yarn 4 can be used as earth.

FIG. 4*a* shows a skirt-formed personal protective clothing body 11 which is formed by using a surface-metallized woven or knitted fabric. In the drawing, a face cover 2 and a backing 3 are attached to the protective clothing body 11, and a conductive discharging yarn 4 is also provided around the hem of the body 11. The face cover 2 is also hemstitched by the conductive discharging yarn 4 which is connected to the yarn 4 provided around the hem of the body 11. The relation between the face cover 2 and the backing 3 and the other arrangement are the same as those of the body shown in FIG. 1.

FIG. 5*a* shows a personal protective clothing body 12 in the form of a cap which is formed by using a surface-metallized woven or knitted fabric. A face cover 2 and a backing 3 are provided on the body 12, and a conductive discharging yarn 4 is provided at the upper edge of the personal protective clothing body 12. The face cover 2 is also hemstitched by the conductive discharging yarn 4 at the upper edge thereof. Both the conductive discharging yarns 4 are connected. The relation between the face cover 2 and the backing 3 and the other arrangement are the same as those of the body shown in FIG. 4.

FIG. 6 shows a coat-formed personal protective clothing 13 which is formed by using a surface-metallized woven or knitted fabric. A face cover 2 and a backing 3 are attached to the body 13 in the same way as the body shown in FIG. 1.

FIG. 7*a* shows the same coat-formed personal protective clothing body as that shown in FIG. 6 with the exception that a conductive discharging mat 5 is attached to the body through a conductive discharging yarn 4. The conductive discharging yarn 4 may be suspended from the mat 5 so that it can be used as earth.

When the operator wears the personal protective clothing bodies 1 and 13 which are shown in FIGS. 1 and 3*a* and FIGS. 6 and 7*a*, respectively, the upper half of the body of the operator including the front, the sides and the back can be protected from surrounding electromagnetic waves. The wearing of the personal protective clothing body 11 shown in FIG. 4*a* also permits the lower half of the body to be protected from electromagnetic waves. The wearing of the personal protective clothing body 13 shown in FIG. 5*a* permits the head of the operator's body to be protected from electromagnetic waves.

As described above, the present invention can be light in weight and can be easily used in under garments, shirts or the like that are comfortable to wear. In addition, if an appropriate face cover having good appearance is used, the operators can usually wear the personal protective clothing like ordinary wears. Further, since the personal protective clothing has good discharging properties, it has good shielding properties and hardly gives a disagreeable impression.

The personal protective clothing of the present invention is suitable as simple personal protective clothing for shielding from electromagnetic waves which the operators of personal computers, word processors and the like can wear on the job.

What is claimed is:

1. Personal protective clothing for shielding electromagnetic waves comprising:

a surface-metallized fiber forming a fabric;

a conductive discharge yarn attached to said fabric for enabling discharge of static electricity therefrom; and a cover attached to said fabric.

2. The clothing as defined in claim 1 wherein said cover is attached to said fabric so as to cover both sides of said fabric.

3. The clothing as defined in claim 1 further comprising an electrical discharge mat for facilitating discharge of static electricity from the fabric.

4. The clothing as defined in claim 1 wherein said surface metallized fiber comprises a plating of one of the group of electrically conductive metals consisting of nickel and copper.

5. The clothing as defined in claim 4 wherein said plating has a thickness of between approximately one-tenth micron and three microns.

6. The clothing as defined in claim 1 wherein said clothing comprises one of the group of garments consisting of a vest, skirt, cap, shirt, under garment and coat.

7. The clothing as defined in claim 1 wherein said fabric is woven.

8. The clothing as defined in claim 1 wherein said fabric is knitted.

9. The clothing as defined in claim 1 wherein said cover is detachable.

10. Personal protective clothing for shielding electromagnetic waves comprising:

a surface-metallized fiber forming a fabric, said fiber comprising a plating of one of the group of electrically conductive metals consisting of nickel and copper having a thickness between approximately one-tenth micron and three microns; and a cover attached to said fabric.

11. The clothing as defined in claim 10 wherein said cover is attached to said fabric so as to cover both sides of said fabric.

12. The clothing as defined in claim 10 wherein said clothing comprises one of the group of garments consisting of a vest, skirt, cap, shirt, under garment and coat.

13. The clothing as defined in claim 10 wherein said fabric is woven.

14. The clothing as defined in claim 10 wherein said fabric is knitted.

15. The clothing as defined in claim 10 wherein said cover is detachable.

* * * * *